US006189820B1

(12) United States Patent
Young

(10) Patent No.: US 6,189,820 B1
(45) Date of Patent: Feb. 20, 2001

(54) METHOD AND APPARATUS FOR ADAPTING A CRUSHER FOR USE WITH DIFFERENT MATERIALS

(75) Inventor: Gregory A. Young, Cedar Rapids, IA (US)

(73) Assignee: Cedar Rapids, Inc.,, Cedar Rapids, IA (US)

( * ) Notice: Under 35 U.S.C. 154(b), the term of this patent shall be extended for 0 days.

(21) Appl. No.: 09/272,993

(22) Filed: Mar. 20, 1999

(51) Int. Cl.[7] ..... B02C 13/286
(52) U.S. Cl. ..... 241/186.3; 241/301
(58) Field of Search ..... 241/186.2, 186.3, 241/257.1, 249, 189.1, 285.2, 285.3, 301

(56) References Cited

U.S. PATENT DOCUMENTS 3,186,651 * 6/1965 Briolini ..... 241/186.2
5,257,743 * 11/1993 Brown ..... 241/257.1
5,657,933 * 8/1997 Williams ..... 241/186.3

* cited by examiner

*Primary Examiner*—Mark Rosenbaum
(74) *Attorney, Agent, or Firm*—Marshall, O'Toole, Gerstein, Murray & Borun

(57) ABSTRACT

A method and apparatus for adapting a horizontal shaft impact crusher for efficient crushing of different types of material are provided. At least two feed plates are provided. The feed plates each have a different feed angle adapted for use with a predetermined type or types of aggregate material. The feed plates can be interchangeably mounted on the crusher to adapt the crusher for enhanced crushing efficiency with respect to the type of material to be crushed.

8 Claims, 4 Drawing Sheets

METHOD AND APPARATUS FOR ADAPTING A CRUSHER FOR USE WITH DIFFERENT MATERIALS

FIELD OF THE INVENTION

The invention relates generally to impact crushers, and, more particularly, to a method and apparatus for adapting a horizontal shaft impact crusher for efficient crushing of different types of materials.

BACKGROUND OF THE INVENTION

Horizontal shaft impact crushers are commonly employed to pulverize many different types of materials including, by way of examples, not limitations, asphalt, concrete, and rock. Such crushers typically include a frame defining a cavity. A rotating impeller driven by an external drive mechanism is disposed within the cavity. The frame includes an opening through which the material to be crushed is inserted into the cavity. One or more breaker plates are generally disposed within the cavity. The rotating impeller repeatedly throws the material to be crushed against the breaker plate(s) thereby breaking the material into small particles.

Horizontal shaft impact crushers generally use a feed plate to help guide the material to be crushed (sometimes referred to as the aggregate) into the hammer circle (i.e., the motion path of the impeller hammers or bars) where it is struck by the impeller bars and crushed. A feed plate is an elongated plate disposed at an angle within the material insertion opening to the cavity of the crusher. The material to be crushed is delivered to the feed plate by a conveyor or the like. The material to be crushed slides down the plate and into the cavity where it is crushed as explained above.

Horizontal shaft impact crushers are generally used to crush a wide range of materials. For example, a crusher may be used to crush asphalt one day, and thereafter be transported to a different site where it is used to crush concrete. Different materials have different physical properties and characteristics that effect their susceptibility to crushing. In view of these differences, applicants have found that it is desirable to insert different materials into crushers at different feed angles. By way of examples, not limitations, concrete and asphalt recycle crushing generally involves large, slabby material that requires a large feed opening to effectively feed the material into the crusher cavity. In contrast, secondary rock crushing involves relatively small uniform material. The crushing of such rock material is generally optimized with a steeper feed angle that allows better penetration into the hammer circle.

Prior art crushers generally employ a single feed plate having a fixed feed angle. This feed angle is generally optimized to work well with one range of material types, but compromises crushing efficiency for other material types.

Feed plates that are removably secured to the frame of an impact crusher are known in the prior art. However, such feed plates are removable to address concerns other than feeding/crushing efficiency such as feed material bridging and assembly considerations. These removable feed plates are not known to have been used in the past to optimize the feed geometry to the properties of the material to be crushed.

SUMMARY OF THE INVENTION

In accordance with an aspect of the invention, a method is provided for adapting a horizontal shaft impact crusher for use with different types of materials. The method includes the steps of: determining a first feed angle for delivering a first type of material to be crushed to the crusher to achieve enhanced crushing of the first type of material; selecting a first feed plate having a second feed angle that at least generally corresponds to the first feed angle; and securing the first feed plate to the crusher.

Optionally, the method may also comprise the steps of: determining a third feed angle for delivering a second type of material to be crushed to the crusher to achieve enhanced crushing of the second type of material; selecting a second feed plate having a fourth feed angle that at least generally corresponds to the third feed angle; removing the first feed plate from the crusher; and securing the second feed plate to the crusher. The third feed angle is different than the first and second feed angles.

In accordance with another aspect of the invention, a kit is provided. The kit includes a first feed plate having a first feed angle for delivering a first type of material to be crushed to the crusher to achieve enhanced crushing of the first type of material. It also includes a second feed plate having a second feed angle for delivering a second type of material to be crushed to the crusher to achieve enhanced crushing of the second type of material. The second feed angle is different than the first feed angle. The first and second feed plates are adapted for interchangeable securement to a crusher to adapt the crusher for enhanced crushing of the first and second types of materials.

Preferably, the kit also includes fasteners for selectively securing the first feed plate or the second feed plate to the crusher.

In accordance with still another aspect of the invention, a feed plate is provided. The feed plate includes a baseplate and a plurality of gussets mounted to the baseplate. Each of the gussets is disposed substantially perpendicularly to the baseplate and defines a crown spaced a distance from the baseplate. The feed plate also includes a faceplate mounted to the gussets. The gussets support the faceplate at an angle to the baseplate. The faceplate has a curved portion dimensioned to mate with and overlie the curved crown of the gussets.

In accordance with a still further aspect of the invention, a method of adapting a horizontal shaft impact crusher for use with different materials comprises determining a first desired feed angle for delivering a first type of material to be crushed to the crusher to achieve enhanced crushing of the first type of material, determining a second desired feed angle for delivering a second type of material to be crushed to the crusher to achieve enhanced crushing of the second type of material, choosing a feed plate from a selected set of feed plates, the selected set of feed plates including a first feed plate having a first desired feed angle adapted for use with the first type of material, the selected set further including a second feed plate having a second desired feed angle adapted for use with the second type of material, and securing the selected feed plate to the crusher.

Other features and advantages are inherent in the apparatus claimed and disclosed or will become apparent to those skilled in the art from the following detailed description and its accompanying drawings.

DESCRIPTION OF THE PREFERRED EMBODIMENTS

Figure 1:
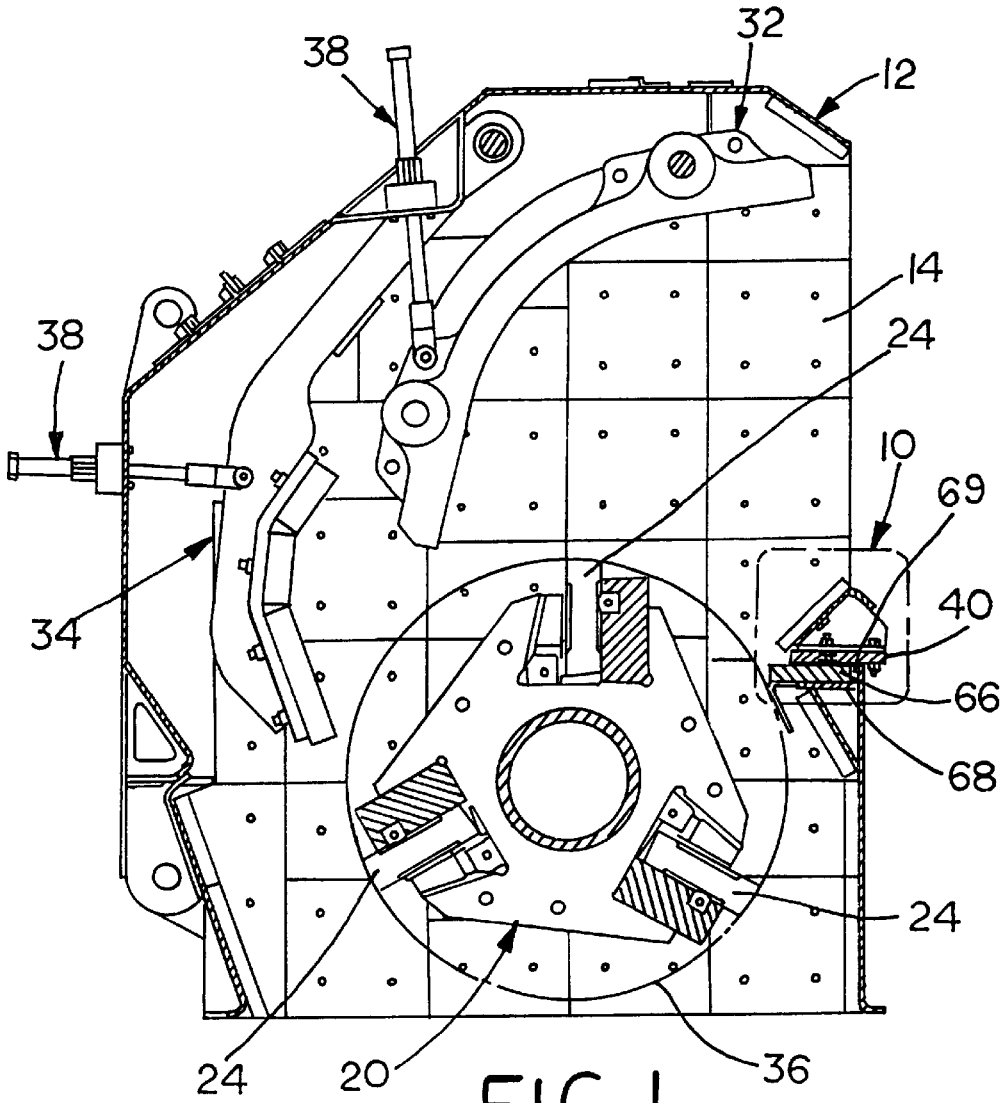
FIG. 1 is a schematic illustration of a horizontal shaft impact crusher employing a removable feed plate constructed in accordance with the teachings of the instant invention.
Figure 3:
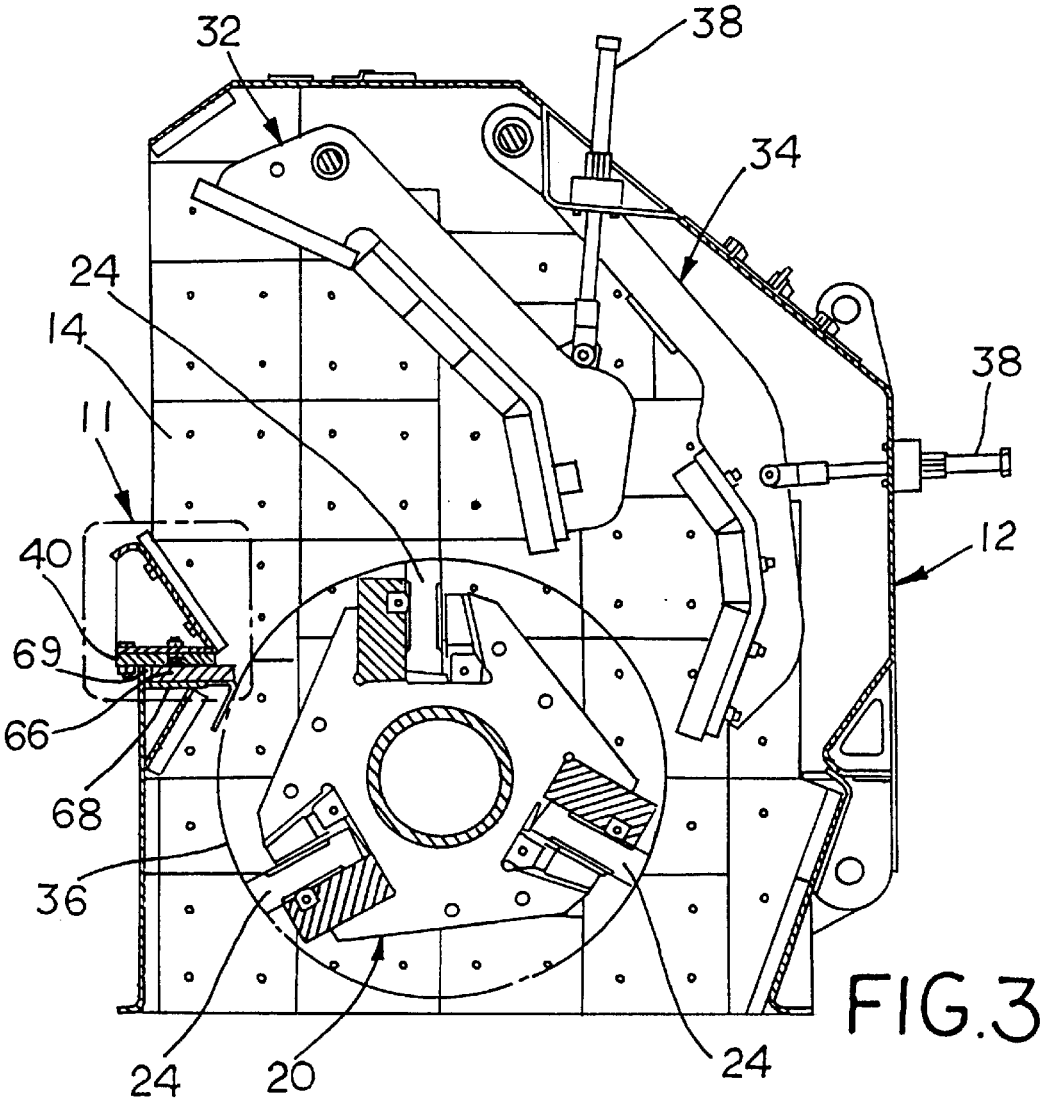
FIG. 3 is a schematic illustration of the horizontal shaft impact crusher of FIG. 1 employing a second removable feed plate constructed in accordance with the teachings of the invention.

Feed plates 10, 11 constructed in accordance with the teachings of the invention are shown in FIGS. 1 and 3 in a preferred environment of use, namely, mounted on a horizontal shaft impact crusher 12. While for clarity of illustration, the feed plates 10, 11 are shown herein mounted on a specific type of crusher 12, persons of ordinary skill in the art will readily appreciate that the teachings of the invention are in no way limited to use with that crusher 12 or to any other particular environment of use. On the contrary, feed plates constructed in accordance with the teachings of the invention may be used with any crusher which would benefit from the advantages they offer without departing from the scope or spirit of the invention.

Figure 5:
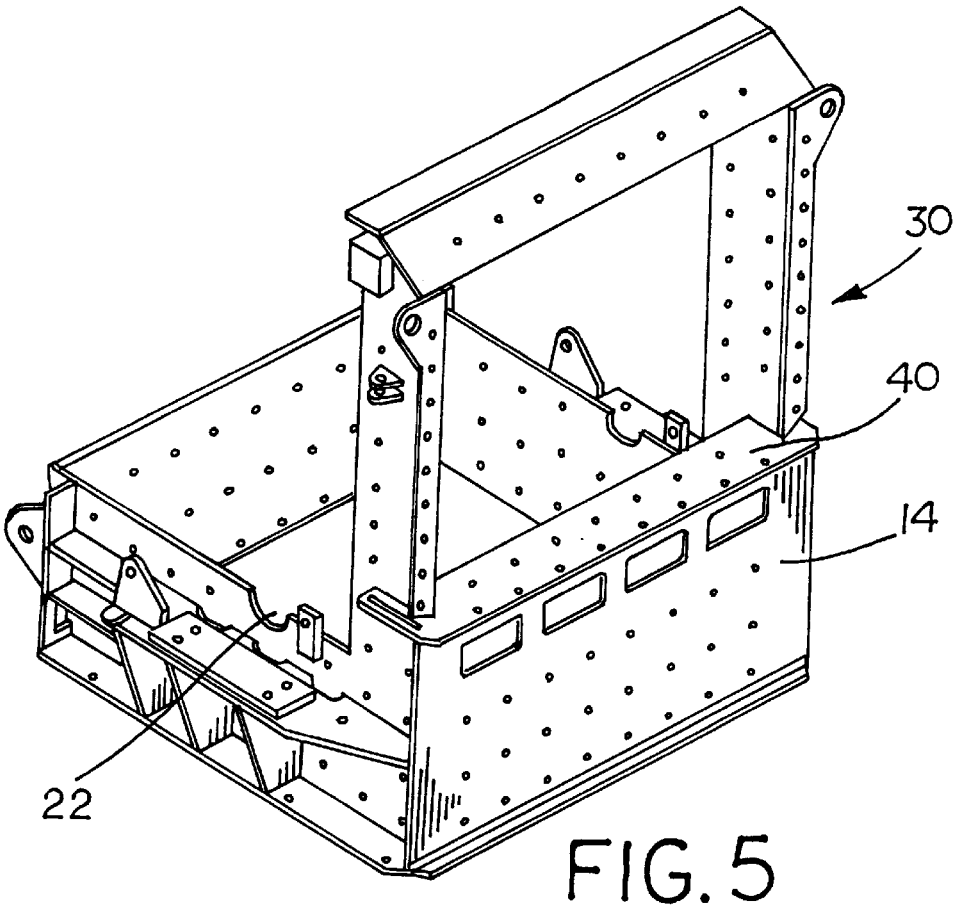
FIG. 5 is a perspective view of a crusher frame.
Figure 6:
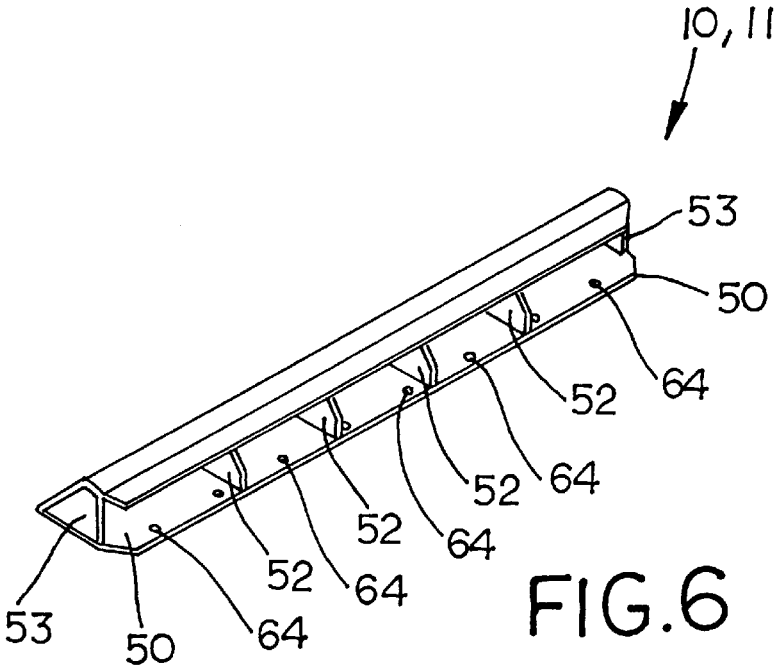
FIG. 6 is a perspective view of a feed plate constructed in accordance with the teachings of the invention.
Figure 7:
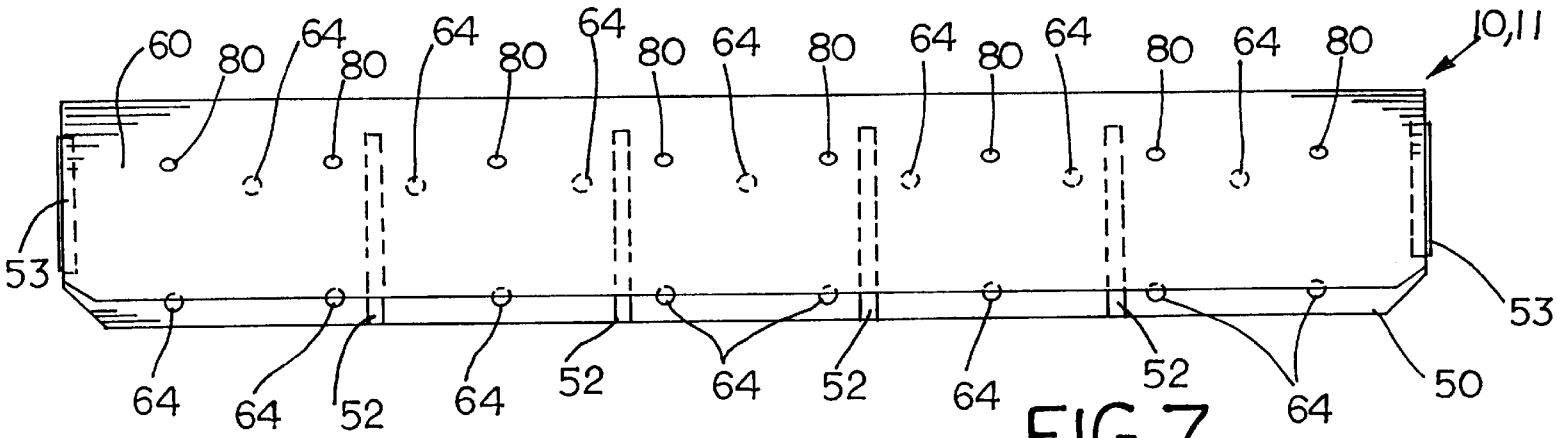
FIG. 7 is a top plan view of the feed plate of FIG. 6.
Figure 8:
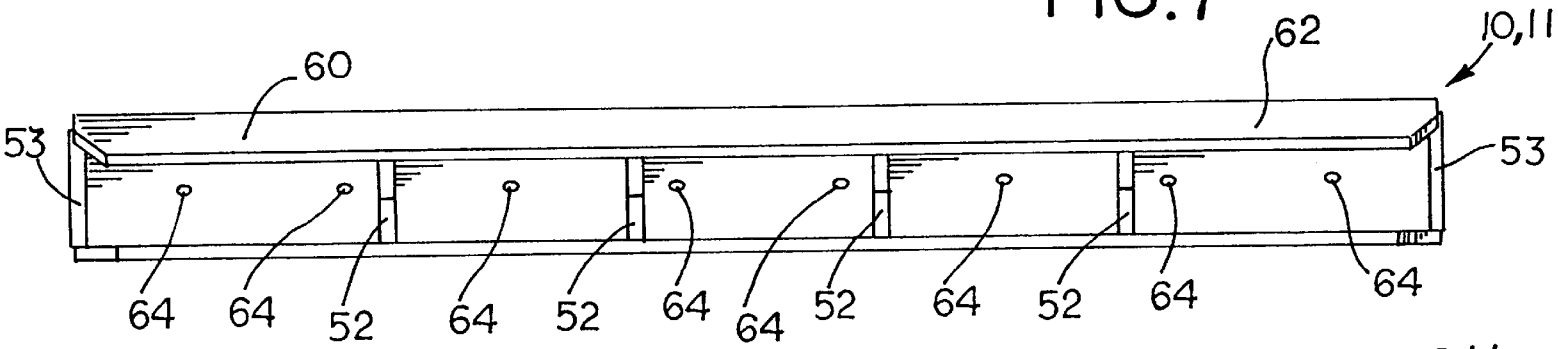
FIG. 8 is a rear elevational view of the feed plate of FIG. 6.
Figure 9:
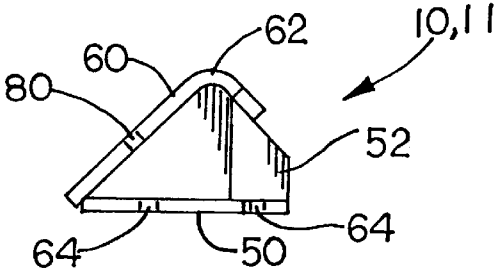
FIG. 9 is a left side view of the feel plate of FIG. 6.

The illustrated crusher 12 is a horizontal shaft impact crusher. Thus, as is well known in the art, the crusher 12 includes a frame or housing 14 that defines an internal cavity (see FIG. 5). An impeller 20 is journalled in a bearing (not shown) mounted adjacent an opening 22 in the frame 14 (see FIG. 5). As shown in FIGS. 1 and 3, the impeller 20 is provided with a plurality of bars or hammers 24 for striking and propelling aggregate material. The impeller 20 is mounted for rotation within the cavity in a generally horizontal position and is coupled to a drive mechanism (not shown) through a gear train (not shown) which imparts rotational movement to the impeller 20. Material to be crushed is inserted into the cavity through an insertion opening 30 defined in the frame 14 (see FIG. 5).

In order to provide a striking surface to break material propelled by the impeller 20 within the cavity, the crusher 12 is further provided with conventional breaker plates 32, 34. As is conventional, the illustrated crusher 12 has a primary breaker plate 32 and a secondary breaker plate 34, both of which are suspended within the cavity adjacent the motion path 36 of the impeller hammers 24. When material is inserted into the crusher 12, the impeller 20 strikes and propels the material against the breaker plates 32, 34.

The breaker plates 32, 34 are suspended within the cavity by adjusting rods 38. The adjusting rods 38 are secured to the braker plates 32, 34 within the cavity. As shown in FIG. 1, the rods 38 extend out of the crusher 12. By adjusting the position of the adjusting rods 38, one can adjust the position of the breaker plates 32, 34 within the cavity.

Figure 2:
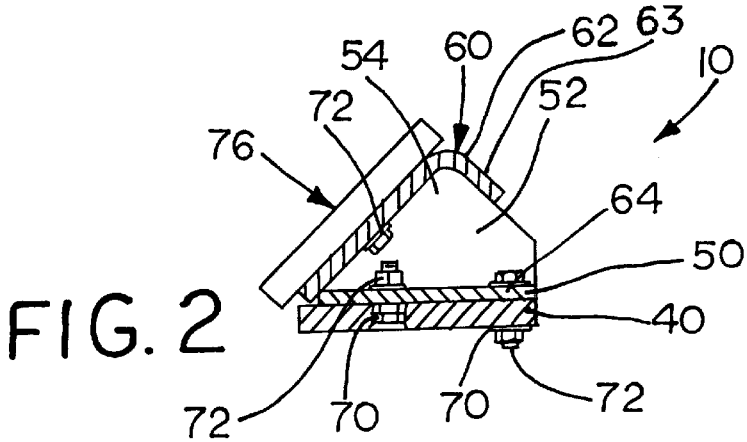
FIG. 2 is a side detail view of the feed plate of FIG. 1.
Figure 4:
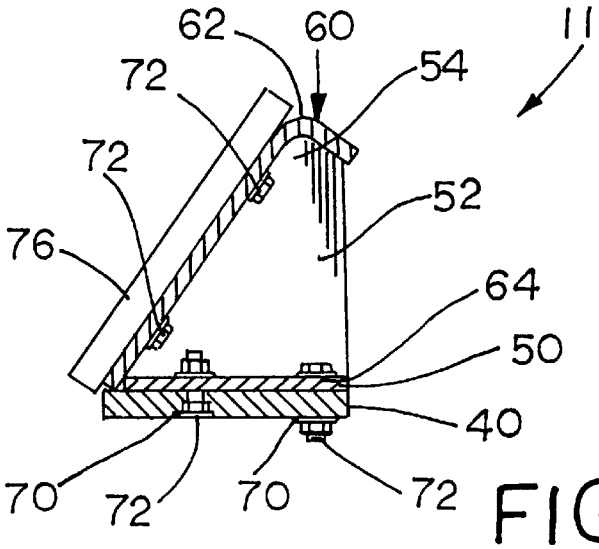
FIG. 4 is a side detail view of the feed plate of FIG. 3.

For the purpose of supplying material to be crushed to the cavity of the crusher 12, a feed plate 10, 11 is removably mounted to a mounting plate 40 formed by the crusher frame 14 (see FIG. 5) adjacent the insertion opening 30. More specifically, in the illustrated embodiment, the crusher 12 may be provided with a kit including two interchangeable feed plates 10, 11. One of the feed plates 10 defines a first feed angle for delivering a first type of material to be crushed to the cavity to achieve enhanced crushing of a first type of material (see FIG. 2). The other feed plate 11 defines a second feed angle for delivering a second type of material to be crushed to the cavity to achieve enhanced crushing of a second type of material (see FIG. 4). In the illustrated embodiment, the first feed angle is smaller than the second feed angle. Thus, by way of example, not limitation, the feed plate 10 of FIGS. 1 and 2 is particularly well suited for feeding large, slabby materials such as concrete or asphalt into the crusher whereas the feed plate 11 shown in FIGS. 3 and 4 is particularly well suited for delivering small, relatively uniform materials into the crusher 12. In any event, as shown in FIGS. 1 and 3, the feed plates 10, 11 can be interchangeably secured to the mounting plate 40 of the crusher 12 to adapt the crusher for enhanced crushing of either the first type of material or the second type of material, whichever is presently available for crushing.

Since, other than their feed angles, the feed plates 10, 11 are substantially identical, the following detailed discussion of the structure of a preferred feed plate refers to both feed plates 10 and 11. Preferably, the feed plates 10, 11 are constructed of steel plate. Turning to FIGS. 6–9, the feed plates 10, 11 are preferably of a length sufficient to extend across the entire opening 30 to the cavity. The feed plates 10, 11 include a substantially planar baseplate 50. They also include a plurality of support plates or gussets 52. The gussets 52 are mounted to the baseplate 50 in a plurality of parallel planes, each of which is perpendicular to the plane of the baseplate 50. While the gussets 52 can be mounted to the baseplate 50 in many ways without departing from the scope or spirit of the invention, in the preferred embodiment the gussets 52 are welded to the baseplate 50.

As most easily seen in FIGS. 2 and 4, the gussets 52 have a generally triangular shape. Each gusset 52 defmes a crown 54 which is spaced a distance away from the baseplate 50. An end plate 53 is preferably mounted at each end of the feed plates 10, 11.

The feed plates 10, 11 are also provided with a faceplate 60 which is mounted on the gussets 52. The gussets 52 support the faceplate 60 at an angle to the baseplate 50. The angle between the faceplate 60 and the baseplate 50 defmes the feed angle of the corresponding feed plate 10 or 11.

To prevent aggregate material from falling behind the faceplate 60 during use of the feed plate 10, 11, the faceplate 60 includes a curved portion 62 which is dimensioned to mate with and overlie the curved crowns 54 of the gussets (see FIGS. 2 and 4). An extension 63 depends downwardly from the curved portion 62.

For the purpose of removably securing the feed plate 10, 11 to the crusher 12, the baseplate 50 of the feed plate 10, 11 defmes a plurality of bores 64. As shown in FIGS. 1 and 3, a shelf 68 is mounted to the housing 14, such that a pocket 69 is created between the mounting plate 40 and the shelf 68. A stripper bar 66 is disposed within the pocket 69, and acts to break or otherwise interrupt the resulting stream of turbulent air created by the rotating impeller 20. The stripper plate 66 is adjustably secured to the housing 14. The mounting plate 40 defines a plurality of bores 70 which are arranged for alignment with the bores 64 of the baseplate 50. As shown in FIGS. 2 and 4, the distal bores 70 of the mounting plate 40 are countersunk whereas the proximal bores 70 are not countersunk.

Fasteners 72 are provided for securing the undersurface of the base plate 50 to the mounting plate 40. Preferably, the fasteners 72 are implemented as threaded bolts and are provided with the kit including the feed plates 10, 11.

As also shown in FIGS. 2 and 4, to extend the useful life of the feed plates 10, 11, each of the feed plates 10, 11 is further provided with a wear plate 76 which is removably secured to its faceplate 60. The wear plate 76 is secured to the faceplate 60 via fasteners 72 (see FIGS. 2 and 4) which are preferably implemented by threaded bolts. To this end, both the faceplate 60 and the wear plate 76 are provided with bores 80 which align when the wear plate 76 and faceplate 60 are assembled.

In operation, the manufacturer of the crusher 12, wholesaler, user, or other person or entity (hereinafter referred to as the "user") identifies the type of material to be crushed. Once the material is identified, the user determines an appropriate feed angle for delivering the identified type of material to the crusher 12 to achieve enhanced crushing of the material. The user then selects a feed plate 10 or 11 having a feed angle that generally corresponds to the determined feed angle. The selected feed plate 10 or 11 is then secured to the crusher 12 as explained above and the crusher 12 is operated to crush the subject material.

If it is subsequently determined that a different type of material is to be crushed, the user determines the appropriate feed angle for delivering the new type of material to the crusher 12 to achieve enhanced crushing. If a different feed angle is desired, the user selects a feed plate 11 or 10 having a feed angle that generally corresponds to the desired feed angle. The feed plate 10 or 11 currently mounted on the crusher 12 is then removed, and the new feed plate 11 or 10 is mounted on the crusher 12. The crusher 12 is then operated.

Persons of ordinary skill in the art will appreciate that a method and kit for adapting a crusher for enhanced crushing of different types of material has been provided. Although the disclosed kit includes only two feed plates 10, 11 together with the plate 76 and fasteners 72, persons of ordinary skill in the art will readily appreciate that other items can be included in the kit without departing from the scope or the spirit of the invention. By way of example, not limitation, additional feed plates having feed angles different than those illustrated herein can be included without departing from the scope or spirit of the invention.

Additionally, persons of ordinary skill in the art will readily appreciate that the feed angles of the illustrated feed plates 10, 11 are for illustration purposes only. Accordingly, it will be appreciated that feed plates 10, 11 with different feed angles can be used without departing from the scope or spirit of the invention.

From the foregoing, persons of ordinary skill in the art will also appreciate that bolt-in feed plates such as those disclosed herein can be used to optimize the feed point location with respect to the hammer circle 36 to achieve better crushing in different applications. Such persons will also appreciate that bolt-in feed plates such as those disclosed herein allow crushers to be retrofit for specific applications within the field with minimal effort.

Although certain instantiations of the teachings of the invention have been described herein, the scope of coverage of this patent is not limited thereto. On the contrary, this patent covers all instantiations of the teachings of the invention fairly falling within the scope of the appended claims either literally or under the doctrine of equivalents.

What is claimed is:

1. A kit for use with a horizontal shaft impact crusher having a rotating impeller proceeding along a circular path, the kit comprising:

a first feed plate having a first feed angle relative to the circular path for delivering a first type of material to be crushed to the crusher to achieve enhanced crushing of the first type of material, the first feed plate further including a first baseplate, a plurality of gussets mounted to the first baseplate, each of the gussets being disposed substantially perpendicularly to the first baseplate and defining a crown spaced a distance from the first baseplate, and a first faceplate mounted to the gussets, the gussets supporting the first faceplate at the first feed angle with respect to the first baseplate; and a second feed plate having a second feed angle relative to the circular path for delivering a second type of material to be crushed to the crusher to achieve enhanced crushing of the second type of material, the second feed angle being different than the first feed angle, the first and second feed plates being adapted for interchangeable securement to a crusher to adapt the crusher for enhanced crushing of the first and second types of materials.

2. A kit as defined in claim 1 further comprising fasteners for selectively securing the first feed plate or the second feed plate to the crusher.

3. A kit as defined in claim 1 wherein the first faceplate has a curved portion dimensioned to mate with and overlie the curved crown of the gussets.

4. A kit as defined in claim 1 wherein the second feed plate further comprises:

a second baseplate;

a plurality of gussets mounted to the second baseplate, each of the gussets being disposed substantially perpendicularly to the second baseplate and defining a crown spaced a distance from the second baseplate; and a second faceplate mounted to the gussets, the gussets supporting the second faceplate at the second feed angle with respect to the second baseplate.

5. A kit as defined in claim 4 wherein the second faceplate has a curved portion dimensioned to mate with and overlie the curved crown of the gussets.

6. A kit comprising:

a first feed plate having a base plate, a face plate, and a plurality of gusset plates interconnecting the base plate and the face plate, each of the gusset plates being shaped to define a first feed angle between the base plate and the face plate, the first feed angle being chosen for delivering a first type of material to be crushed to the crusher to achieve enhanced crushing of the first type of material; and a second feed plate having a base plate, a face plate, and a plurality of gusset plates interconnecting the base plate and the face plate, each of the gusset plates being shaped to define a second feed angle between the base plate and the face plate, the second feed angle being chosen for delivering a second type of material to be crushed to the crusher to achieve enhanced crushing of the second type of material, the second feed angle being different than the first feed angle, the first and second feed plates being adapted for interchangeable securement to a crusher to adapt the crusher for enhanced crushing of the first and second types of materials.

7. The kit of claim 6, wherein each of the gusset plates of the first feed plate and each of the gusset plates of the second feed plate include a curved crown, and further wherein the face plate of the first feed plate and the face plate of the second feed plate include a curved portion shaped to overlie the curved crown of its corresponding gusset plates.

8. A kit for use with a horizontal shaft impact crusher having a rotatable impeller rotating through a circular path, the kit comprising:

a first feed plate having a base plate, a face plate, and a plurality of gusset plates interconnecting the base plate and the face plate, the gusset plates being adapted to position the face plate to thereby define a first feed path, the first feed path being disposed at a first angle relative to the circular path, the face plate having a curved portion and a downwardly depending extension, each of the gusset plates having a curved crown adapted to receive thereon the curved portion of the face plate; and a second feed plate having a base plate, a face plate, and a plurality of gusset plates interconnecting the base plate and the face plate, the gusset plates being adapted to position the face plate to thereby define a second feed path, the second feed path being disposed at a second angle relative to the circular path, the face plate having a curved portion and a downwardly depending extension, each of the gusset plates having a curved crown adapted to receive thereon the curved portion of the face plate.

* * * * *